US008460413B2

(12) United States Patent
Schmidt

(10) Patent No.: US 8,460,413 B2
(45) Date of Patent: Jun. 11, 2013

(54) METHOD AND APPARATUS FOR SUPPLY OF LOW-BTU GAS TO AN ENGINE GENERATOR

(75) Inventor: Darren D. Schmidt, Thompson, ND (US)

(73) Assignee: Energy & Environmental Research Center Foundation, Grand Forks, ND (US)

( * ) Notice: Subject to any disclaimer, the term of this patent is extended or adjusted under 35 U.S.C. 154(b) by 1019 days.

(21) Appl. No.: 11/683,636

(22) Filed: Mar. 8, 2007

(65) Prior Publication Data

US 2007/0209642 A1 Sep. 13, 2007

Related U.S. Application Data

(60) Provisional application No. 60/780,704, filed on Mar. 9, 2006.

(51) Int. Cl.
*C10J 1/00* (2006.01)

(52) U.S. Cl.
USPC ..... 48/219; 123/274

(58) Field of Classification Search
USPC ..... 123/195 C, 90.27, 90.34, 193.5, 123/274; 48/61
See application file for complete search history.

(56) References Cited

U.S. PATENT DOCUMENTS 3,650,155 A * 3/1972 McJones ..... 73/714
4,070,146 A 1/1978 Straitz, III
4,111,170 A * 9/1978 Nakajima et al. ..... 123/684
4,169,441 A * 10/1979 Hirano et al. ..... 123/698
4,381,641 A * 5/1983 Madgavkar et al. ..... 60/777
4,489,562 A 12/1984 Snyder et al.

(Continued)

FOREIGN PATENT DOCUMENTS

EP 309044 A * 3/1989

OTHER PUBLICATIONS

International Search Report dated Feb. 26, 2008.

*Primary Examiner* — Matthew Merkling
(74) *Attorney, Agent, or Firm* — Conley Rose, P.C.; Rodney B. Carroll

(57) ABSTRACT

A carburetion system and method for adapting a low-Btu gas source with a low-Btu gas consumer. Pressure-based air-gas mixers geometrically appropriate for the carburetion system and method. The carburetion system comprises a low-Btu gas inlet, a gas outlet, a zero-pressure regulator, and at least one pressure-based air-gas mixer capable of maintaining a volumetric air to low-Btu gas ratio of no more than about 2:1. The method comprises diverting a low-Btu gas to a gas outlet when the gas consumer is off. The method further comprises, during operation of the consumer, diverting low-Btu gas to a zero-pressure regulator in order to balance low-Btu gas pressure with air pressure, passing low-Btu gas to at least one pressure-based air-gas mixer capable of maintaining a volumetric air to low-Btu gas ratio of no more than about 2:1, mixing the low-Btu gas with air in the at least one pressure-based air-gas mixer to form an air-gas mixture, and sending the air-gas mixture to the consumer. A venturi air-gas mixer comprising at least one venturi gas intake and at least one venturi air intake wherein the at least one venturi gas intake has a cross-sectional area at least equal to the cross-sectional area of the at least one venturi air intake whereby the venturi air-gas mixer is capable of maintaining a volumetric air-to-gas ratio of no more than about 1:1.

18 Claims, 4 Drawing Sheets

U.S. PATENT DOCUMENTS 4,531,462 A 7/1985 Payne
4,694,792 A * 9/1987 Uuskallio ..... 123/179.11
4,859,173 A 8/1989 Davis, Jr. et al.
5,240,409 A 8/1993 Xiong
5,261,382 A 11/1993 Nikolai
5,809,979 A 9/1998 Tsuda et al.
5,957,681 A * 9/1999 Hansen ..... 431/202
6,092,364 A * 7/2000 Stellwagen ..... 60/39.463
6,201,029 B1 * 3/2001 Waycuilis ..... 518/703
6,932,052 B1 8/2005 Fulton
2002/0019180 A1 * 2/2002 Yoshida et al. ..... 440/89
2002/0112403 A1 * 8/2002 Pope et al. ..... 48/127.3
2003/0191199 A1 * 10/2003 O'Rear ..... 518/705
2004/0011050 A1 * 1/2004 Inoue ..... 60/773
2004/0011053 A1 1/2004 Murakami et al.

* cited by examiner

100

METHOD AND APPARATUS FOR SUPPLY OF LOW-BTU GAS TO AN ENGINE GENERATOR

CROSS-REFERENCE TO RELATED APPLICATIONS

This application claims benefit from provisional patent application Ser. No. 60/780,704 filed Mar. 9, 2006, which is hereby incorporated herein by reference in its entirety for all purposes as if reproduced in full below.

STATEMENT REGARDING FEDERALLY SPONSORED RESEARCH OR DEVELOPMENT

Not applicable.

BACKGROUND

1. Field of the Invention

This invention relates generally to the field of gaseous fuel carburetion. More specifically, the invention relates to a low-Btu gas carburetion system and method for use with a consumer such as an engine generator that may be operated intermittently.

2. Background of the Invention

The production of energy is critical to the economic survival of developed nations. The use of recoverable sources of energy provides advantages to process industries in terms of efficiency and economy and may decrease negative environmental impact. Successful utilization of low-Btu gases for fuel may provide such advantages. Low-Btu gases include, among others, biogas or digester gas, landfill gas, associated oil well gas, and manufactured gases from either fossil fuels or biomass gasification.

Existing methods of providing gaseous fuels to engine generator systems are limited to gases having heating values of 500 Btu/scf and greater. These methods are not feasible with low-Btu fuels. Although fuel injection systems have been disclosed for low-Btu gas control, the development of pressure-based carburetion methods for low-Btu gas has not been successful. Commercial carburetion for high-Btu fuels includes diaphragm and venturi mixers for control of the air-to-fuel ratio. In high-Btu carburetion, air is typically naturally aspirated, and fuel is supplied by a zero-pressure regulator The zero-pressure regulator maintains a consistent pressure differential between the air and fuel supply to the carburetor, which may be important for proper mixing within the carburetor geometry. High-Btu carburetors for fuels such as natural gas operate at volumetric air-to-fuel ratios of 10:1, where the heating value of the fuel is 1000 Btu/scf. In contrast, a typical low-Btu fuel requires an air-to-fuel ratio of 1:1, where the heating value of the fuel is 100 Btu/scf. The significant volume of additional gas to be mixed with air in a low-Btu carburetor cannot be addressed with high-Btu geometry carburetors. Additionally, while high-Btu fuel is typically supplied from a gas source that may be intermittently supplied, low-Btu fuel is typically supplied continuously from a source such as, for example, a gasifier. Gas sources such as gasifiers are generally operated continuously to maintain proper reactor temperature and consistent gas quality. It is undesirable and impracticable to interrupt the continuous production of gas. A need exists, therefore, for a means to couple a continuous source of low-Btu gas to a consumer such as an engine generator that may be operated intermittently and to provide the proper air-to-fuel ratio to the consumer.

Methods for adapting low-Btu gas (producer gas, biomass gas, or syngas) to engine generator systems have remained limited to manual valve mixing or electronic control. The integration of an engine generator with a continuous source of low-Btu gas has not previously been demonstrated in the art.

U.S. Pat. No. 4,278,064 by Regueiro describes a fuel control system for a dually fueled power unit. The patent discloses a gasifier coupled to a diesel engine with electronically controlled valves specific for load control. The object of the invention is to control the dual fueling of the engine by electronic fuel injection and does not address traditional pressure-based carburetion.

U.S. Pat. No. 5,070,851 by Janisch discloses a traditional pressure-based air-gas mixer or carburetor intended for low-Btu gas specific to Briggs and Stratton engines, which are typical small engines used for lawnmowers and other small engine applications. The object of the invention is to supplement gasoline fuel. Janisch does not address large natural gas or diesel engine generation sets and the means by which large engine generators can be supplied low-Btu gas at the correct air-to-fuel ratio. Janisch does not address a means for coupling a continuous gas supply to an intermittent consumer via a gas outlet.

Other methods of introducing gas to piston engines include fumigation. U.S. Pat. No. 4,694,802 by Lowi refers to previous fumigation efforts and describes a means comprising variable area venturi. Lowi does not address the application of low-Btu gas or the application of a gas outlet device for coupling a continuous gas supply to an intermittent consumer.

U.S. Pat. No. 5,895,507 by Southards describes a diesel engine coupled to a black liquor gasification process. Specifics regarding the coupling of the process to the diesel engine are not claimed. King et al. in U.S. Pat. No. 5,724,948 reveals a method for applying biogas to an internal combustion engine. King et al. employs a standard gaseous carburetor for fuels having heating values above 500 Btu/scf and does not address the challenges concerning the implementation of low-Btu fuels. Vinyard in U.S. Pat. No. 6,805,107 provides a method for dual-fuel operation of an engine utilizing syngas and propane. Vinyard does not address pressure-based air-gas mixing or carburetion, but rather discloses electronic control.

Accordingly, there is an ongoing need for a carburetion system and method for supplying low-Btu gas at the proper volumetric air-to-gas ratio from a continuous gas source to a consumer such as an engine generator that may be intermittently operated and to which the continuous gas source may be permanently coupled.

BRIEF SUMMARY OF THE PREFERRED EMBODIMENTS

These and other needs in the art are addressed by the presently disclosed carburetion system. The carburetion system comprises a low-Btu gas inlet, a gas outlet, a zero-pressure regulator, and at least one pressure-based air-gas mixer capable of maintaining a volumetric air-to-gas ratio of no more than 2:1. In embodiments, the gas outlet comprises a flare device. In embodiments, the zero-pressure regulator is coupled to a load control valve. In embodiments, the carburetion system further comprises a low-Btu gas source. In embodiments, the low-Btu gas source is a continuous gas source. In embodiments, the low-Btu gas source is a gasifier. In embodiments, the low-Btu gas source is a biomass gasifier. In embodiments, the low-Btu gas source is a gas-producing oil well. In embodiments, the carburetion system comprises a plurality of air-gas mixers. In certain arrangements, the plurality of air-gas mixers are connected in series. In embodiments, the at least one pressure-based air-gas mixer comprises a venturi mixer. In embodiments, the venturi air-gas mixer comprises at least one venturi gas intake and at least one venturi air intake. In embodiments, the venturi air-gas mixer comprises a plurality of venturi gas intakes. In specific embodiments, the carburetion system comprises at least one venturi air-gas mixer comprising at least one venturi gas intake and at least one venturi air intake, wherein the at least one venturi gas intake has a cross-sectional area at least equal to the cross-sectional area of the at least one venturi air intake. In embodiments, the at least one pressure-based air-gas mixer comprises a diaphragm mixer. In embodiments, the at least one pressure-based air-gas mixer is capable of maintaining a volumetric air-to-gas ratio of from about 1:1 to about 2:1. In embodiments, the at least one pressure-based air-gas mixer is capable of maintaining a volumetric air-to-gas ratio of about 1:1. In embodiments, the carburetion system is coupled to a consumer. In embodiments, the carburetion system is coupled to a consumer that is capable of being operated intermittently. In embodiments, the consumer is an engine generator. In embodiments, the engine generator is selected from the group consisting of gas turbines, microturbines, and piston engines.

The needs in the art enumerated above are also addressed herein via a method of adapting a low-Btu gas source with a consumer, the method comprising: when the consumer is not in operation, diverting a low-Btu gas to a gas outlet; and, when the consumer is in operation: diverting low-Btu gas to a zero-pressure regulator in order to balance gas pressure with air pressure, passing low-Btu gas to at least one pressure-based air-gas mixer that is capable of maintaining a volumetric air-to-gas ratio of no more than 2:1, mixing the low-Btu gas with air in the air-gas mixer to form an air-gas mixture, and sending the air-gas mixture to the consumer. In embodiments, the low-Btu gas source is continuous. In embodiments, the consumer of the method is an engine generator. In embodiments, the at least one pressure-based air-gas mixer comprises a venturi mixer. Alternatively, the at least one pressure-based air-gas mixer comprises a diaphragm mixer. In embodiments, passing low-Btu gas to at least one pressure-based air-gas mixer that is capable of maintaining a volumetric air-to-gas ratio of no more than 2:1 comprises passing the low-Btu gas through a plurality of air-gas mixers. In some embodiments of the method comprising a plurality of air-gas mixers, the plurality of air-gas mixers are connected in series. In some embodiments of the method comprising a plurality of air-gas mixers, low-Btu gas is supplied to the plurality of air-gas mixers in parallel and air is supplied to the plurality of air-gas mixers in series. In some embodiments of the method comprising a plurality of air-gas mixers, the air-gas mixers comprise diaphragm mixers. In some embodiments of the disclosed method, the at least one pressure-based air-gas mixer is capable of maintaining a volumetric air-to-gas ratio of from about 1:1 to about 2:1. In certain embodiments of the method, the at least one pressure-based air-gas mixer is capable of maintaining a volumetric air-to-gas ratio of about 1:1.

The method and apparatus of the present disclosure incorporate a gas outlet to enable a consumer to operate intermittently while permanently coupled to a gas source that may be continuously supplied.

Also herein disclosed are pressure-based air-gas mixers suitable for use with low-Btu gas streams, the consumers of which prefer air-to-gas ratios lower than air-to-gas ratios suitable for high-Btu gas streams. One disclosed air-gas mixer suitable for incorporation in the system and method of the present disclosure is a venturi air-gas mixer comprising at least one venturi gas intake and at least one venturi air intake wherein the at least one venturi gas intake has a cross-sectional area at least equal to the cross-sectional area of the at least one venturi air intake whereby the venturi air-gas mixer is capable of maintaining a volumetric air-to-gas ratio of no more than about 1:1.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

NOTATION AND NOMENCLATURE

Figure 1:
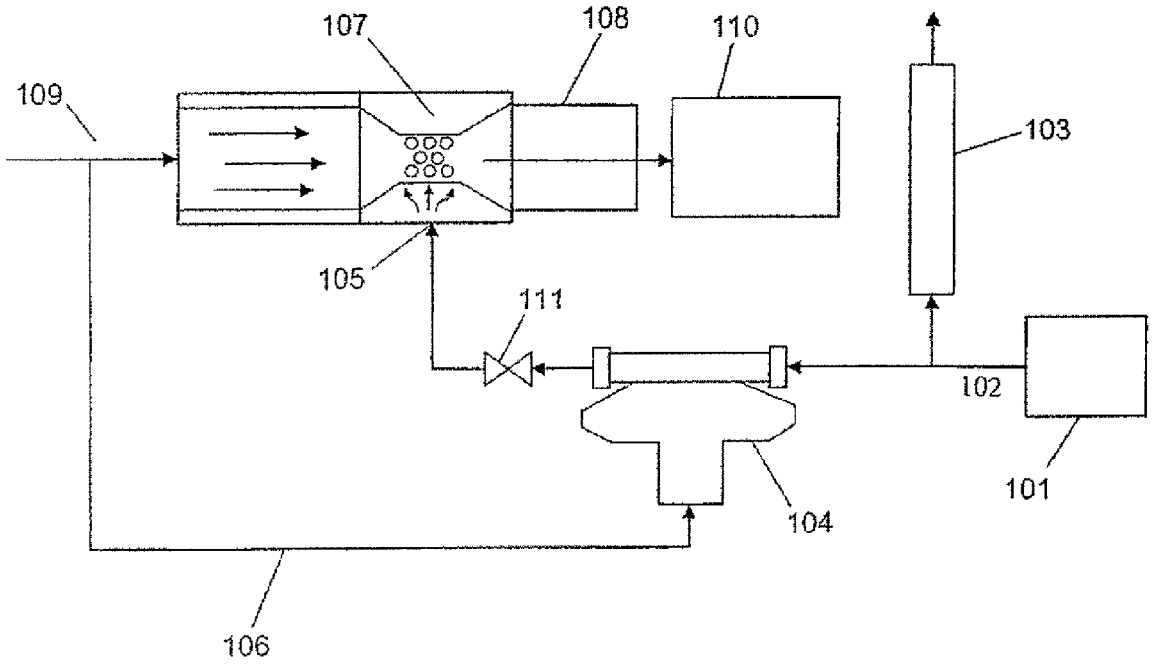
FIG. 1 is a schematic of an embodiment according to the present disclosure of a low-Btu gas carburetion system comprising a venturi air-gas mixer.

Certain terms are used throughout the following description and claims to refer to particular system components. This document does not intend to distinguish between components that differ in name but not function.

In the following discussion and in the claims, the terms "including" and "comprising" are used in an open-ended fashion and, thus, should be interpreted to mean "including, but not limited to . . . ".

"Low-Btu gas" refers to any fuel gas that has a heating value of less than 500 Btu/scf.

The term "intermittent consumer" is used to refer to any consumer that is capable of intermittently consuming low-Btu gas. The use of the term "intermittent" conveys the capability of the consumer to operate intermittently although, in certain embodiments, the consumer may be capable of continuous operation.

"Engine generator" refers to any machinery or device that consumes some type of fuel in order to generate energy.

"Pressure-based air-gas mixer" refers to any mechanical device used to mix air and fuel gas that does not rely on electronics or sensors.

DETAILED DESCRIPTION OF THE PREFERRED EMBODIMENTS

System Overview

The system and method of the present disclosure will now be described with reference to FIG. 1. The carburetion system and method of the present disclosure enable safe coupling of a low-Btu gas source 101 to a consumer 110 regardless of the potential intermittency of operation of consumer 110 and the potential continuous operation of gas source 101 by incorporating a gas outlet 103. The carburetion system and method of the present disclosure also enable appropriate control of the air to low-Btu fuel ratio for use in consumer 110 by incorporating at least one pressure-based air-gas mixer 107 with the proper geometry to appropriately mix low-Btu gas with air, and zero-pressure regulator 104 that maintains pressure balance between air and fuel to the at least one pressure-based air-gas mixer 107.

FIG. 1 illustrates an embodiment according to the present disclosure of a carburetion system 100 for a low-Btu gas. Carburetion system 100 comprises low-Btu gas inlet 102, gas outlet 103, zero-pressure regulator 104, and at least one pressure-based air-gas mixer 107. In embodiments, the carburetion system further comprises load control valve 111.

Gas Source/Gas

In FIG. 1, low-Btu gas is supplied from gas source 101. Low-Btu gas is any gas that has a heating value less than about 500 Btu/scf. Examples of low-Btu gas include without limitation, biomass gas, digester gas, landfill gas, associated oil well gas, and manufactured gases from fossil fuels and combinations thereof. Gas source 101 comprises any suitable source of low-Btu fuel gas. Suitable gas sources 101 include, without limitation, fossil fuel gasifiers, biomass gasifiers, gas-producing oil wells, and combinations thereof. In an embodiment, the low-Btu gas is a fossil fuel-based oil field gas diluted during processing to levels having heating values less than 500 Btu/scf The coupling of this gas to, and the use of this gas by, a consumer via the herein disclosed system and method may present an economic advantage over the common practice of continuously venting or flaring such low-Btu gas during oil production. In embodiments, gas source 101 is a gasification reactor that converts a carbonaceous material including, but not limited to, coal, petroleum, petroleum coke, biomass, and combinations thereof into a gas source comprising carbon monoxide and hydrogen. In specific embodiments, gas source 101 is a biomass gasifier operating at low pressure. In embodiments, low-Btu gas is a synthetic gas produced via biomass gasification of a biomass fuel. Suitable biomass is, for example, wood, agricultural residue, process waste and combinations thereof In embodiments, gas source 101 is a biomass gasifier, and low-Btu gas comprises hydrogen, methane, carbon monoxide, carbon dioxide, and nitrogen with a heating value of about 130 Btu/scf.

Gas Outlet and Zero-Pressure Regulator

In embodiments, low-Btu gas source 101 is connected to gas outlet 103 and zero-pressure regulator 104. Gas from gas source 101 and low-Btu gas inlet 102 may be diverted to gas outlet 103 or to zero-pressure regulator 104. In certain embodiments, a valve or switch (not shown) serves to control the supply of gas from gas source 101 to gas outlet 103 and zero-pressure regulator 104.

In embodiments, gas outlet 103 comprises a flare device to flare low-Btu gas to the atmosphere. A process flare is often associated with an oil well gas source. Gas outlet 103 may serve to ensure proper gas pressure to consumer 110. Alternatively, gas outlet 103 is coupled to a gas pipeline or to a storage device, as is known in the art.

Gas is diverted to gas outlet 103 when carburetion system 100 is not in use, thus allowing gas source 101 to be continuously supplied to and connected with carburetion system 100 even during periods when consumer 110 is not in use. When carburetion system 100 is in use, low-Btu gas may be diverted to zero-pressure regulator 104 rather than to gas outlet 103. Zero-pressure regulator 104 serves to maintain the consistency of the air-to-gas ratio in a pressure-based air-gas mixer 107 by equalizing, via connection 106, the pressure of low-Btu gas entering pressure-based air-gas mixer 107 at mixer gas inlet 105 with the pressure of incoming air entering the at least one pressure-based air-gas mixer 107 at air supply inlet 109. Zero-pressure regulator 104 may be any suitable regulator as known to those of skill in the art. In particular embodiments, zero-pressure regulator 104 is coupled to load control valve 111. In embodiments comprising load control valve 111, load control valve 111 works in conjunction with zero-pressure regulator 104 to adjust the flow of gas to obtain the proper ratio of air-to-gas in pressure-based air-gas mixer 107. Typically, load control valve 111 is manually operated. Alternatively, load control valve 111 is electronically controlled by, for example, a computer.

Air-Gas Mixer

The system of the present disclosure comprises one or more pressure-based air-gas mixers 107. Air-gas mixer 107 may be any mixer known to those of skill in the art to provide a consistent air-to-gas ratio to consumer 110 in the range of from about 2:1 to about 1:1. The geometry of air-gas mixer 107 accommodates the increased volume of gas that is mixed with low-Btu gas as compared to air-gas mixers processing high-Btu gas. In the embodiment of FIG. 1, zero-pressure regulator 104 is in fluid communication with pressure-based air-gas mixer 107 via mixer gas inlet 105. Pressure-based air-gas mixer 107 comprises at least one air supply inlet 109. In embodiments, carburetion system 100 further comprises an air filtration unit as is known to those in the art to filter air before and/or after the air enters pressure-based air-gas mixer 107 via air supply inlet 109. Pressure-based air-gas mixer 107 is capable of mixing air with low-Btu gas in a controlled manner to yield an air-gas mixture. In preferred embodiments, pressure-based air-gas mixer 107 is capable of maintaining the air-gas mixture at a volumetric ratio of about 1:1. Alternatively, pressure-based air-gas mixer 107 is capable of maintaining the air-gas mixture at a volumetric ratio of about 2:1. In still other embodiments, pressure-based air-gas mixer 107 is capable of maintaining the air-gas mixture at a volumetric ratio of from 2:1 to about 1:1. In embodiments, carburetion system 100 comprises at least one pressure-based air-gas mixer. In alternative embodiments, carburetion system 100 comprises a singular pressure-based air-gas mixer.

Venturi Mixer

Figure 2:
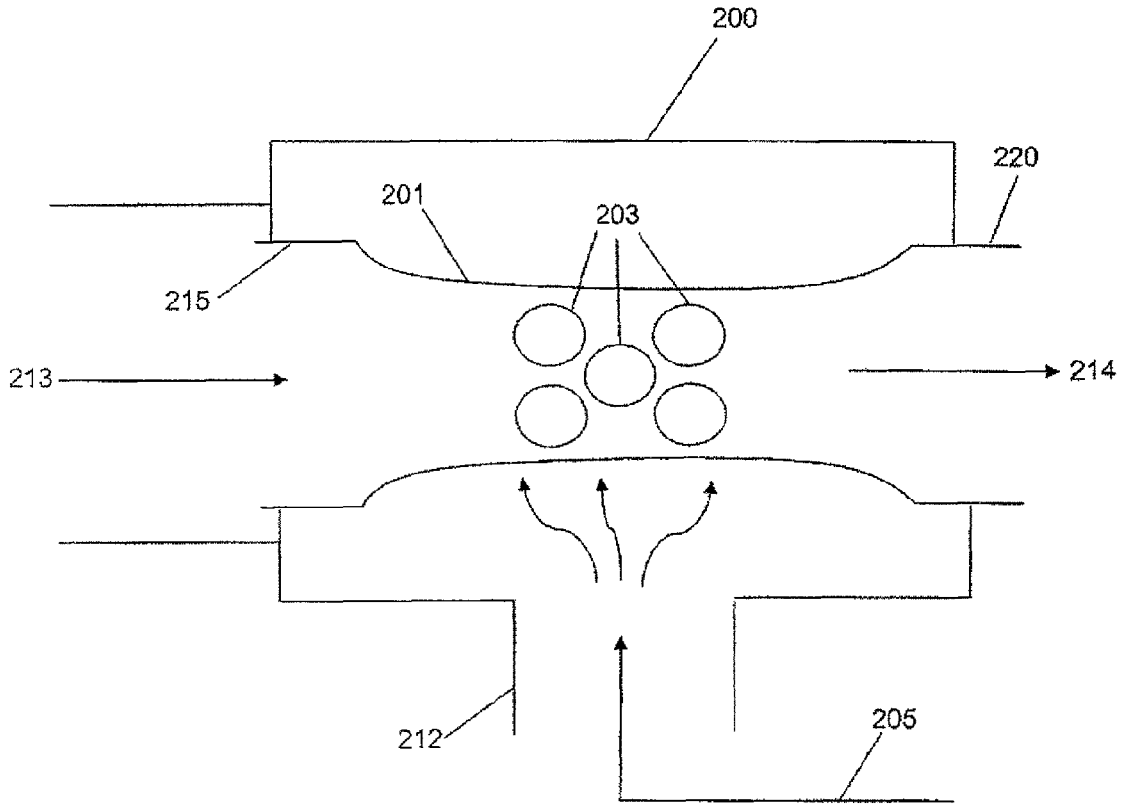
FIG. 2 is a schematic of an embodiment of a suitable venturi air-gas mixer.

In certain embodiments, pressure-based air-gas mixer 107 comprises a venturi mixer. A suitable venturi mixer 200 is depicted in FIG. 2. Low-Btu gas stream 205 enters venturi mixer 200 at gas inlet 212 while air 213 enters venturi 201 at venturi air intake 215. Pressure balance between low-Btu gas stream 205 and air 213 is achieved via zero-pressure regulator 104 shown in FIG. 1. Low-Btu gas enters venturi 201 at venturi gas intakes 203. In typical embodiments, venturi mixer 200 comprises a plurality of venturi gas intakes 203. In embodiments, venturi gas intakes 203 are designed such that the volumetric ratio of the air-to-gas mixture is about 1:1. In such embodiments, venturi gas intakes 203 may have a total cross-sectional area equal to the cross-sectional area of venturi air intake 215. Without being limited by theory, such a design may prevent undue resistance to gas flow. In alternative embodiments, venturi gas intakes 203 are designed such that the volumetric ratio of the air-to-gas mixture is about 2:1. Venturi gas intakes 203 may comprise any suitable design known to those of skill in the art to efficiently mix the required volume of low-Btu gas with air. Suitable designs for venturi gas intakes 203 include, without limitation, Jets, holes, nozzles, orifices, and combinations thereof. Air-gas mixture 214 leaves venturi mixer 200 at venturi air-gas outlet 220. In some embodiments, commercially available venturi mixers are modified for use with the carburetion system of the present disclosure.

Diaphragm Mixer(s)

In embodiments, the carburetion system of the present disclosure comprises one or more diaphragm mixers. In the embodiment shown schematically in FIG. 3, carburetion system 300 comprises three diaphragm mixers 322. Gaseous fuel is supplied at low-Btu gas inlet 318 and diverted to gas outlet 319 and/or zero-pressure regulator 320. In certain embodiments, a valve or switch (not shown) serves to control the supply of gas from a gas source to gas outlet 319 and zero-pressure regulator 320. Due to the restricted geometry at gas jet 326, diaphragm mixer geometry does not enable large volumetric flows of gas relative to the volumetric flow of air. A plurality of diaphragm mixers 322 are thus employed in some embodiments of carburetion system 300. In a particular embodiment, diaphragm mixers 322 are arranged in series along the air flow path within intake manifold 308 of an engine generator (engine generator not shown in FIG. 3). The air-gas mixture exits the one or more pressure-based air-gas mixers, in various embodiments, via intake manifold 308, as air-gas mixture stream 317, and enters an air-gas consumer, such as an engine generator (not shown in FIG. 3). In some embodiments comprising multiple mixers, the mixers are arranged in series with air supplied in series and gas supplied in parallel. Gas may be supplied in parallel at one or more gas inlets, such as gas inlets 305 of FIG. 3. Such embodiments allow a large volumetric supply of low-Btu gas to the mixers in order to achieve the desired air-to-fuel ratio in the consumer, typically from about 2:1 to about 1:1.

Figure 3:
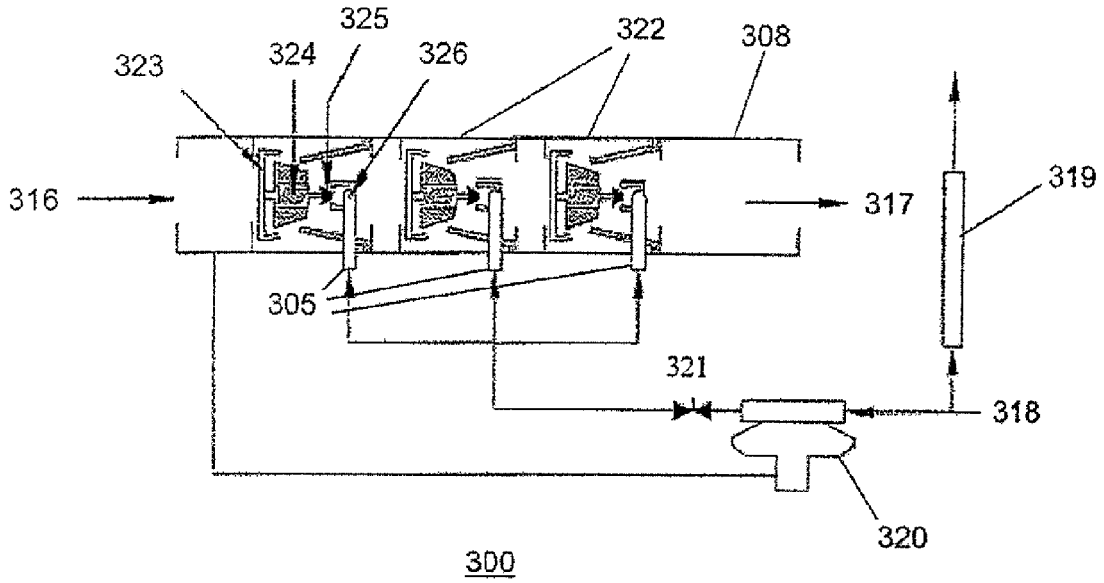
FIG. 3 is a schematic of an embodiment according to the present disclosure of a low-Btu gas carburetion system comprising a series of diaphragm air-gas mixers.
Figure 4:
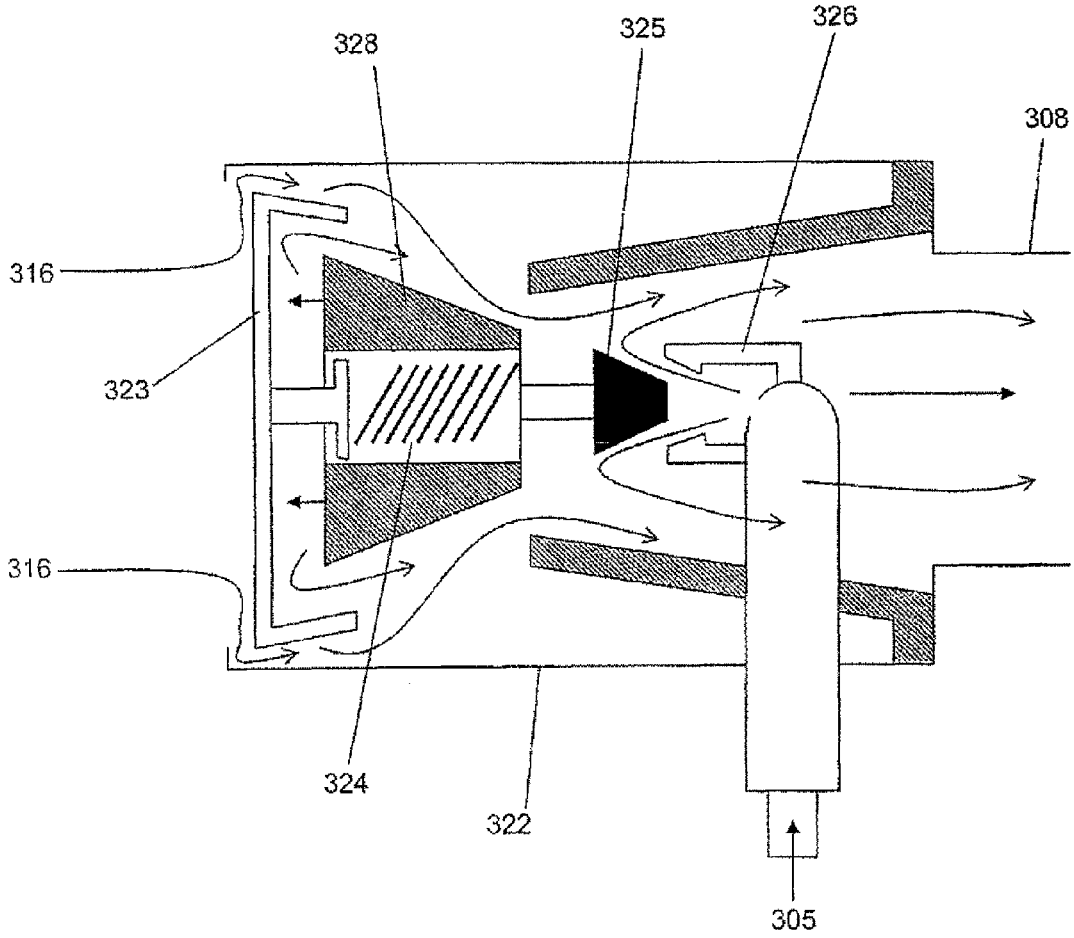
FIG. 4 is a schematic of a diaphragm air-gas mixer 322 of the embodiment of FIG. 3.

FIG. 4 is a schematic of a suitable diaphragm mixer 322 for carburetion system 300. Diaphragm mixer 322 comprises diaphragm 323, air valve spring plunger 324, gas jet valve 325, air intake valve 328, and gas jet 326. Function of diaphragm mixer 322 will now be described with reference to FIGS. 3 and 4. As flow is initiated in intake manifold 308, a vacuum is created in intake manifold 308 causing a pressure differential between intake manifold 308 and the one or more diaphragm mixers 322. As a result, air from air inlet 316 is drawn from diaphragm mixers 322 into intake manifold 308 causing airflow. The drawing of air from the space between diaphragm 323 and air intake valve 328 creates a vacuum that causes air valve spring plunger 324 to release gas jet valve 325 from gas jet 326. Low-Btu gas flows in from gas inlet(s) 305. The geometry of gas jet 326 and adjustment of load control valve 321 (as depicted in FIG. 3) provide additional control of the air-to-gas ratio. In various embodiments, the geometry of gas jet 326 may be altered by varying the cross sectional area of gas jet 326, by employing differently shaped nozzles or jets, etc. In some embodiments, diaphragm mixer 322 comprises a plurality of gas jets 326. In further embodiments, commercially available diaphragm mixers are modified for use with the carburetion system of the present disclosure.

Intermittent Consumer

Referring back to FIG. 1, carburetion system 100 is coupled to consumer 110. In an embodiment, air-gas mixture exits pressure-based air-gas mixer 107 and enters intake manifold 108 of consumer 110. Air-gas mixture from intake manifold 108 then enters consumer 110 as fuel. In embodiments, consumer 110 is operated intermittently. In embodiments, consumer 110 is an engine generator. Examples of engine generators for use with the carburetion system of the present disclosure include, without limitation, gas turbines, microturbines, piston engines, diesel engines, and combinations thereof. A suitable piston engine may utilize spark ignition or compression ignition. In preferred embodiments, carburetion system 100 is coupled to intake manifold 108 of consumer 110. In embodiments, carburetion system 100 is mounted within consumer intake manifold 108 of consumer 110. In embodiments, pressure-based air-gas mixer 107 is mounted within intake manifold 108 of consumer 110. Intake manifold 108 may be an integral part of consumer 110. In embodiments, low-Btu gas source 101 is a biomass gasifier and consumer 110 is a piston engine. In other embodiments, low-Btu gas source 101 is a biomass gasifier and consumer 110 is a diesel engine.

Method

Another aspect of the present disclosure is a method of supplying a mixture having an appropriate air-to-low-Btu gas ratio to a consumer that may be operated intermittently, the low-Btu gas being supplied by a low-Btu gas source that may be operated continuously. The method enables a low-Btu gas source to operate continuously regardless of the potential intermittency of the consumer. The method will now be described with reference to FIG. 1. Low-Btu gas enters carburetion system 100 from low-Btu gas source 101 via low-Btu gas inlet 102. During periods of shutdown of consumer 110 (e.g., engine generator) or to apply proper low-Btu gas pressure to consumer 110, low-Btu gas is diverted to gas outlet 103 from which gas is flared to the atmosphere or sent to storage or further processing. Diverting low-Btu gas to gas outlet 103 while consumer 110 is off allows a continuously supplied low-Btu gas source 101 to be connected to consumer 110 without shutting down gas source 101. In certain embodiments, low-Btu gas flows to a valve or switch (not shown) for controlling the flow of low-Btu gas from gas source 101 to gas outlet 103 and zero-pressure regulator 104. It is to be understood that, although the method and system of the present disclosure are designed to be capable of incorporating a continuously operating gas source, the method and system disclosed herein may also be operable with an intermittently operated low-Btu gas source.

When consumer 110 (e.g., engine generator) is operating, low-Btu gas is diverted to zero-pressure regulator 104 to balance the gas pressure between low-Btu gas at air-gas mixer gas inlet 105 with the pressure of air entering air-gas mixer 107 via air supply inlet 109; balance is maintained via connection 106. In particular embodiments, the gas pressure is further adjusted by the use of load control valve 111 which is coupled to zero-pressure regulator 104. Low-Btu gas from zero-pressure regulator 104 enters pressure-based air-gas mixer 107 wherein air and gas are mixed at the appropriate ratio for use in consumer 110. In alternative embodiments, the air and gas are mixed in pressure-based air-gas mixer 107 to a volumetric ratio of from about 1:1 to about 2:1. In embodiments, the air and gas are mixed in pressure-based air-gas mixer 107 to a volumetric ratio of about 1:1. In alternative embodiments, the air and gas are mixed in pressure-based air-gas mixer 107 to a volumetric ratio of about 2:1. In embodiments, low-Btu gas from zero-pressure regulator 104 is divided into a plurality of streams and fed in a parallel manner to a plurality of pressure-based diaphragm air-gas mixers 322 (see FIG. 3).

Air-gas mixture from pressure-based air-gas mixer 107 and having the desired air-to-gas ratio for use as fuel passes through consumer intake manifold 108 to consumer 110. In embodiments, consumer 110 is an engine generator. Suitable engine generators include, without limitation, gas turbines, microturbines, piston engines, diesel engines, and combinations thereof.

While the preferred embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Accordingly, the scope of protection is not limited by the description set out above, but is only limited by the claims which follow, that scope including all equivalents of the subject matter of the claims.

The disclosures of all patents, patent applications, and publications cited herein are hereby incorporated herein by reference in their entirety, to the extent that they provide exemplary, procedural, or other details supplementary to those set forth herein. The discussion of a reference in this disclosure is not an admission that it is prior art to the present invention, especially any reference that may have a publication date after the priority date of this application.

What is claimed is:

1. A carburetion system for low-Btu gas comprising:

a zero pressure regulator connected to a low-Btu gas inlet line;

a plurality of pressure-based air-gas mixers downstream of the zero pressure regulator, the plurality of pressure-based air-gas mixers each having an air inlet and a gas inlet, wherein the gas inlet cross-sectional area in each pressure-based air-gas mixer of the plurality of pressure-based air-gas mixers is at least equal to the air inlet cross-sectional area; wherein the plurality of air-gas mixers are connected in series, wherein the plurality of air-gas mixers are arranged with an air supply in series and a gas supply in parallel, and wherein the plurality of pressure-based air-gas mixers is configured to provide a fuel having a volumetric air to gas ratio of no more than about 2:1; and a gas outlet upstream of the zero pressure regulator and connected with the low-Btu gas inlet line such that low-Btu gas can be diverted to the gas outlet, the zero pressure regulator or both.

2. The carburetion system of clam 1, wherein the gas outlet comprises a flare device.

3. The carburetion system of claim 1, wherein the zero pressure regulator is coupled to a load control valve.

4. The carburetion system of claim 1, further comprising a low-Btu gas source upstream of the zero pressure regulator and connected thereto via the low-Btu gas inlet line.

5. The carburetion system of claim 4, wherein the low-Btu gas source comprises a continuous gas source.

6. The carburetion system of claim 4, wherein the low-Btu gas source comprises a biomass gasifier.

7. The carburetion system of claim 4, wherein the low-Btu gas source comprises a gas producing oil well.

8. The carburetion system of claim 1, wherein at least one pressure-based air-gas mixer of the plurality of pressure-based air-gas mixers comprises a venturi mixer.

9. A carburetion system for low Btu gas comprising:

a gas inlet;

a gas outlet;

a zero pressure regulator; and at least one pressure-based air-gas mixer configured to provide a fuel having a volumetric air to gas ratio of no more than about 2:1, wherein the at least one pressure-based air-gas mixer comprises a venturi mixer comprising at least one venturi, wherein the at least one venturi comprises at least one venturi gas intake and at least one venturi air intake, wherein the at least one venturi gas intake comprises an opening into the at least one venturi, wherein a cross-sectional area of the at least one venturi gas intake is at east as large as a cross-sectional area of the at least one venturi air intake, wherein the cross-sectional area of the at least one venturi gas intake is the area of the opening of the at least one venturi gas intake into the at least one venturi, and wherein the cross-sectional area of the at least one venturi air intake is the area of the at least one air intake adjacent and upstream of the at least one venturi.

10. The carburetion system of claim 8, wherein the venturi mixer comprises a plurality of venturi gas intakes.

11. The carburetion system of claim 1, wherein at least one of the plurality of pressure-based air-gas mixers comprises a diaphragm mixer.

12. The carburetion system of claim 1, wherein the plurality of pressure-based air-gas mixers is configured to provide a fuel having a volumetric air to gas ratio in the range of from about 1:1 to about 2:1.

13. The carburetion system of claim 12, wherein the plurality of pressure-based air-gas mixers is configured to provide a fuel having a volumetric air to gas ratio of about 1:1.

14. The carburetion system of claim 1, wherein the carburetion system further comprises a consumer configured to consume the fuel.

15. The carburetion system of claim 14 wherein the consumer is capable of being operated intermittently.

16. The carburetion system of claim 14, wherein the consumer comprises an engine generator.

17. The carburetion system of claim 16, wherein the engine generator is selected from the group consisting of gas turbines, microturbines, and piston engines.

18. A venturi air-gas mixer comprising at least one venturi, the at least one venturi comprising at least one venturi gas intake and at least one venturi air intake, wherein the at least one venturi gas intake comprises an opening into the at least one venturi, wherein the at least one venturi gas intake has a cross-sectional area at least equal to the cross-sectional area of the at least one venturi air intake whereby the venturi air-gas mixer is capable of maintaining a volumetric air to gas ratio of no more than about 2:1, wherein the cross-sectional area of the at least one venturi gas intake is the area of the opening of the at least one venturi gas intake into the at least one venturi, and wherein the cross-sectional area of the at least one venturi air intake is the area of the at least one air intake adjacent and upstream of the at least one venturi.

* * * * *

UNITED STATES PATENT AND TRADEMARK OFFICE

CERTIFICATE OF CORRECTION

PATENT NO. : 8,460,413 B2
APPLICATION NO. : 11/683636
DATED : June 11, 2013
INVENTOR(S) : Darren D. Schmidt It is certified that error appears in the above-identified patent and that said Letters Patent is hereby corrected as shown below:

In the Claims:

Column 10, line 10, replace “is at east” with --is at least--

Signed and Sealed this
Eleventh Day of March, 2014

Michelle K. Lee

Michelle K. Lee
*Deputy Director of the United States Patent and Trademark Office*